US007661165B2

(12) United States Patent
Piccinini et al.

(10) Patent No.: US 7,661,165 B2
(45) Date of Patent: Feb. 16, 2010

(54) ADJUSTABLE-SPRINGING MATTRESS

(75) Inventors: Antonio Piccinini, Padua (IT); Filippo Piccinini, Padua (IT)

(73) Assignee: New Wind S.r.l., Ostuni (IT)

( * ) Notice: Subject to any disclaimer, the term of this patent is extended or adjusted under 35 U.S.C. 154(b) by 0 days.

(21) Appl. No.: 12/080,232

(22) Filed: Apr. 1, 2008

(65) Prior Publication Data

US 2008/0276376 A1 Nov. 13, 2008

(30) Foreign Application Priority Data

May 9, 2007 (IT) ..... MI20070173 U

(51) Int. Cl.
*A47C 23/04* (2006.01)

(52) U.S. Cl. ..... 5/720; 5/717; 5/718; 5/724; 5/730; 5/731; 267/81; 267/84

(58) Field of Classification Search ..... 5/720, 5/655.8, 716, 719, 740, 690, 718, 724, 731, 5/652.1, 655.7, 901, 655.9, 171, 730; 267/81, 267/84, 93, 103

See application file for complete search history.

(56) References Cited

U.S. PATENT DOCUMENTS

| | | | | |
|---|---|---|---|---|
| 2,461,062 | A * | 2/1949 | Kane | 5/720 |
| 4,451,946 | A * | 6/1984 | Stumpf | 5/655.8 |
| 5,850,648 | A * | 12/1998 | Morson | 5/724 |
| 6,948,205 | B2 * | 9/2005 | Van Der Wurf et al. | 5/718 |

* cited by examiner

*Primary Examiner*—Peter M Cuomo
*Assistant Examiner*—Nicholas Polito
(74) *Attorney, Agent, or Firm*—Kirschstein, et al.

(57) ABSTRACT

An adjustable spring mattress includes a plurality of parallel-epipedal bodies made of a synthetic elastic material and being mutually coupled together. Each body houses an inner coil spring, and is separated from adjoining bodies through a throughgoing hole. The bodies are partially separated by V-shaped separating slots which longitudinally and transversely traverse the mattress.

6 Claims, 3 Drawing Sheets

ADJUSTABLE-SPRINGING MATTRESS

BACKGROUND OF THE INVENTION

The present invention relates to an adjustable-spring mattress.

It is already known in the prior art to provide bed mattress assemblies, or sofa cushion or seating arrangements, by using coil springs, housed in small coil spring bags.

Said coil springs, in particular, are arranged depending on the size of the mattress to be made, and frequently, the mattress assembly is coated by a soft and plushy material layer, and the thus made assembly is introduced into a fabric material envelope to provide a finished mattress.

SUMMARY OF THE INVENTION

The aim of the present invention is to provide an improved mattress the resilient or elastic properties of which can be selected at will, to allow the mattress to be easily adapted to mattress requirements and seating characteristics.

According to the present invention, the above mentioned aim is achieved by the fact that the adjustable spring mattress comprises a plurality of parallelepipedal mattress bodies, made of a resilient synthetic material and being mutually connected, that each body houses an inner coil spring, that each body is separated from adjoining bodies by a throughgoing hole and that on each side of the mattress, the bodies are partially separated by a V-shape separating channel longitudinally and transversely extending across the mattress.

BRIEF DESCRIPTION OF THE DRAWINGS

The subject matter of the present invention will be disclosed in a more detailed manner hereinafter, with reference to an embodiment thereof which is shown, by way of an indicative example, in the accompanying drawings, where.

DETAILED DESCRIPTION OF THE PREFERRED EMBODIMENTS

Figure 1:
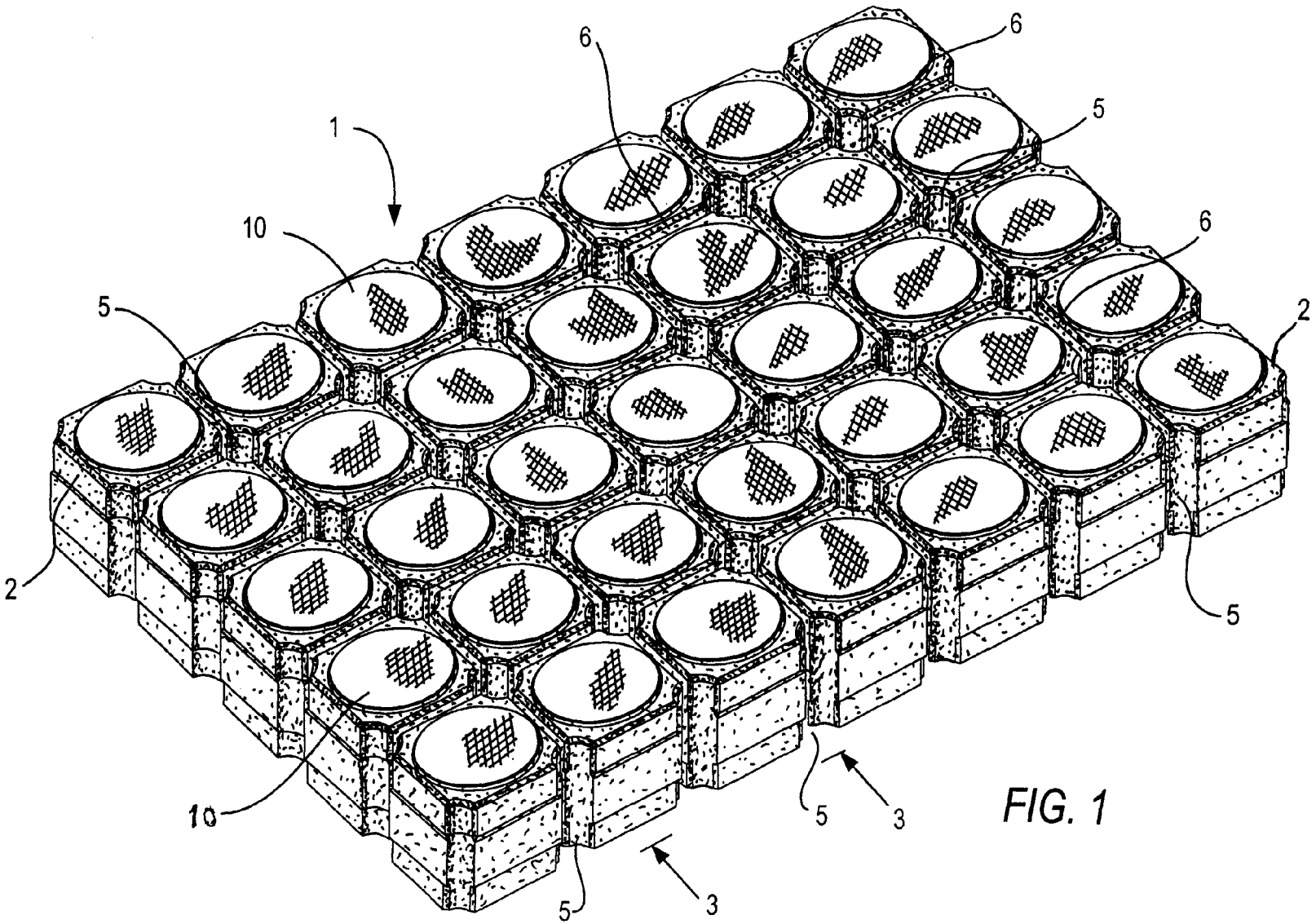
FIG. 1 is a perspective view showing a mattress element.

FIG. 1 shows a mattress element, generally indicated by the reference number 1.

Said mattress element 1 is made by foaming a suitable viscoelastic material.

It is herein possible to join several elements 1 to provide a larger mattress.

The element 1 is made as an integral part and comprises a plurality of substantially parallelepipedal shaped bodies 2.

Figure 2:
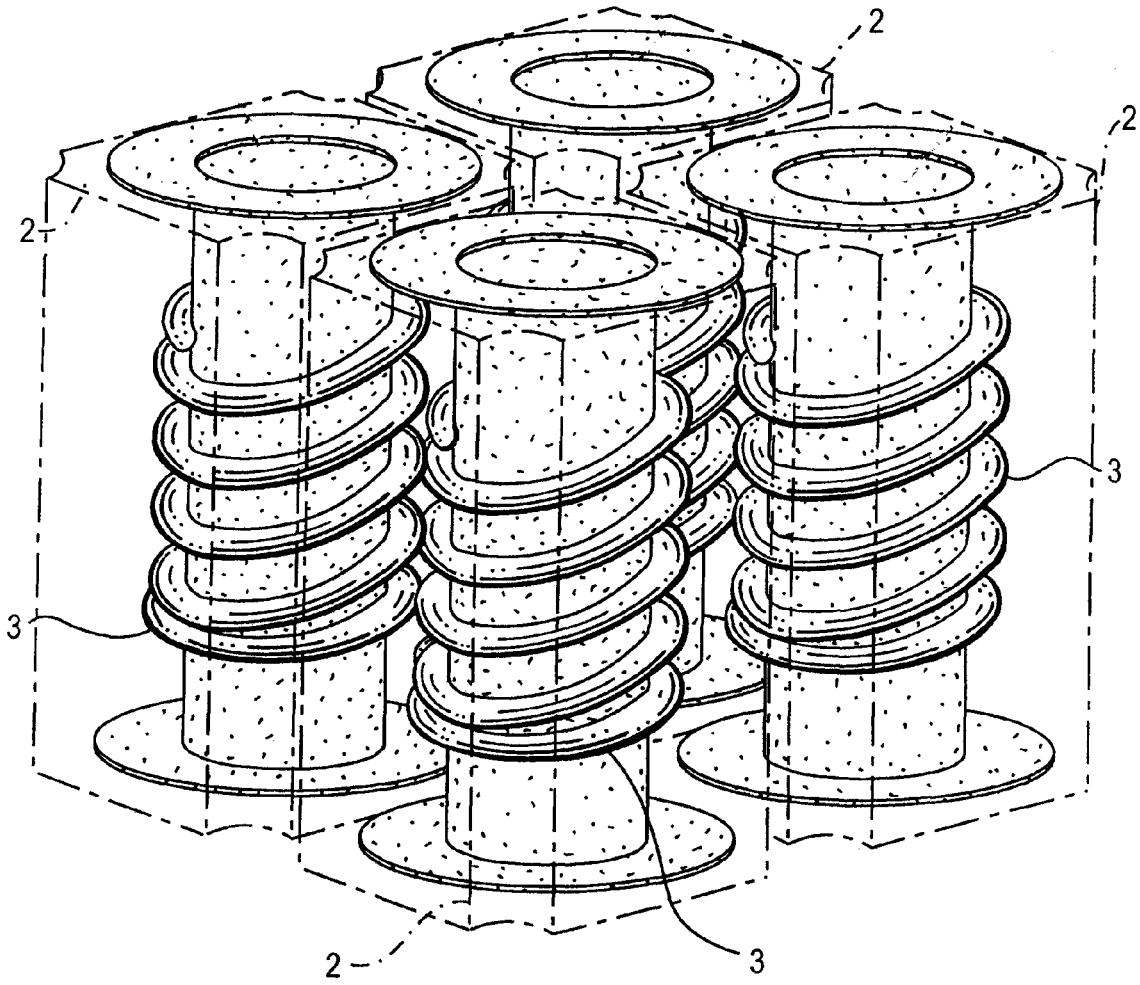
FIG. 2 is a ghost perspective view showing the interior of bodies of the mattress.

Each said body 2, made of a resilient soft material, comprises, in its inside, a spring 3 (not shown in FIG. 1), said springs 3 being advantageously made of a plastic or synthetic material. FIG. 2 shows a transparent assembly including four bodies 2 made of a synthetic material, advantageously foamed polyurethane, or other viscoelastic material, each said single element 2 encompassing or including an inner coil spring 3.

Figure 3:
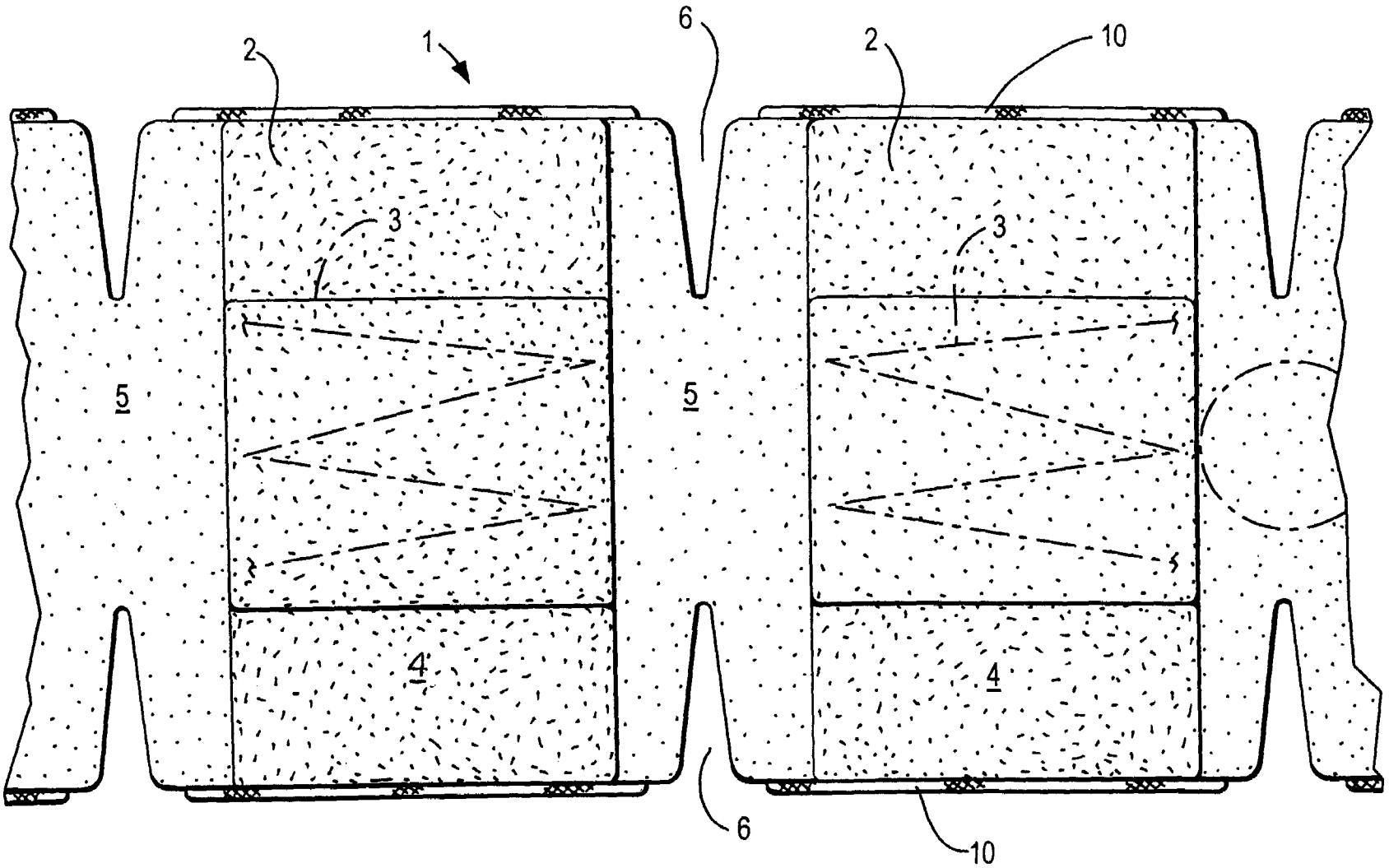
FIG. 3 is a front view taken on line 3-3 of FIG. 2 showing a detail of the mattress.

FIG. 3, which is a view taken according to the arrow 3-3 of FIG. 1, shows a detail of the mattress 1.

FIG. 3 clearly shows two elements 2, housing in their inside the spring 3, made of a synthetic or plastic material, each said spring 3 being encompassed by the resilient or elastic synthetic material forming the body of the mattress 1, and schematically shown in FIG. 3 by the reference number 4.

The individual bodies 2 are partially separated from one another by a throughgoing hole, indicated by the reference number 5.

The provision of said throughgoing holes 5 allows to achieve a greater ventilation of the mattress 1.

Moreover, said individual elements 2 are separated, on each surface thereof, by V-shape slots 6, said slots 6 which traverse, in two directions, the body of the mattress 1, operate to provide the mattress with enhanced deforming and fitting properties for fitting the support construction, for example of a bed, a sofa or a chair.

The bodies housing the springs 3 are closed by small cover elements 10.

The invention claimed is:

1. A spring mattress, comprising:

a plurality of parallelepiped shaped bodies integrally joined together to form a mattress element having opposite sides, each body constituted of a resilient synthetic material;

a plurality of coil springs each housed within each body and constituted of a synthetic material;

a plurality of longitudinal separating channels extending in mutual parallelism longitudinally across each side of the mattress element;

a plurality of transverse separating channels extending in mutual parallelism transversely across each side of the mattress element, the transverse separating channels extending perpendicularly to, and intersecting, the longitudinal separating channels; and a plurality of ventilation holes extending through the mattress element at intersections of the longitudinal separating channels and the transverse separating channels.

2. The mattress according to claim 1, wherein the resilient synthetic material of each body is a foamed viscoelastic material.

3. The mattress according to claim 2, wherein the viscoelastic material is polyurethane.

4. The mattress according to claim 1, wherein each of the separating channels has a V-shaped cross-section.

5. The mattress according to claim 1, wherein each coil spring is embedded in the resilient synthetic material of a respective body.

6. The mattress according to claim 1, and a plurality of covers, one for each body.

* * * * *